United States Patent [19]

Sheng

[11] Patent Number: 4,804,346

[45] Date of Patent: Feb. 14, 1989

[54] OPEN MOUTH BLOWING BUBBLE TOY

[76] Inventor: Lin M. Sheng, No. 195, Chieng-Kou Rd., Hsintien Shih, Taipei Hsien, Taiwan

[21] Appl. No.: 116,688

[22] Filed: Nov. 4, 1987

[51] Int. Cl.[4] ..... A63H 33/28

[52] U.S. Cl. ..... 446/17; 446/19

[58] Field of Search ..... 446/15, 16, 17, 18

[56] References Cited

U.S. PATENT DOCUMENTS

| | | | |
|---|---|---|---|
| 2,624,974 | 1/1953 | Fisher et al. | 446/17 |
| 2,625,768 | 1/1953 | Magnus | 446/17 |
| 2,853,829 | 9/1958 | Greene | 446/18 |
| 2,987,847 | 6/1961 | Jones | 446/17 |
| 3,093,925 | 6/1963 | Greene | 446/18 |
| 3,736,694 | 6/1973 | Lebensfeld | 446/16 |
| 3,775,898 | 12/1973 | Kalish | 446/17 |

FOREIGN PATENT DOCUMENTS

| | | | |
|---|---|---|---|
| 696574 | 10/1964 | Canada | 446/15 |

*Primary Examiner*—Robert A. Hafer
*Assistant Examiner*—Michael Brown
*Attorney, Agent, or Firm*—Lowe, Price, LeBlanc, Becker & Shur

[57] ABSTRACT

A bubble blowing toy is described. The toy consists of a figure with a mouth which opens. The bubble blowing liquid is contained in a reservoir in the lower jaw. The upper jaw has a depending flange which rests in the liquid when the mouth is closed. There is a cylinder disposed within the body. Air admitted to the cylinder drives a piston to the rear of the cylinder. A rod carried by the piston encounters a depending flange from the head member which causes the head member to pivot and open the mouth. The air also rushes through an opening in the cylinder, through an air channel and through a nozzle disposed within the mouth which blows bubbles from the film of bubble blowing liquid extending from the upper jaw to the lower jaw.

2 Claims, 2 Drawing Sheets

OPEN MOUTH BLOWING BUBBLE TOY

BACKGROUND OF THE INVENTION

This invention relates to toys and articles of amusement and in particular to a device for blowing bubbles which emerge from the open mouth of a toy figure.

SUMMARY OF THE INVENTION

The device of this invention utilizes a toy figure which has a hinged mouth that is normally closed. A reservoir of bubble blowing liquid is contained within the lower jaw and a flange depending from the upper jaw extends downwardly into the liquid when the mouth is closed. The object contains a piston and cylinder and a blow pipe extends into the cylinder. When air is admitted through the blow pipe into the cylinder, the piston is slidably displaced causing a rod extending therefrom to encounter a depending internal flange which in turn causes the upper jaw to open. In addition, when the piston travels to the full extent of the cylinder an opening is presented whereby the air rushes through the opening and into a nozzle which is directed through the open mouth of the figure. The open mouth has a film of bubble blowing material extending across it from the flange to the reservoir and therefore bubbles are blown by the nozzle. A plurality of nozzles may be provided to blow a number of bubble in parallel.

DETAILED DESCRIPTION OF THE INVENTION

Figure 3:
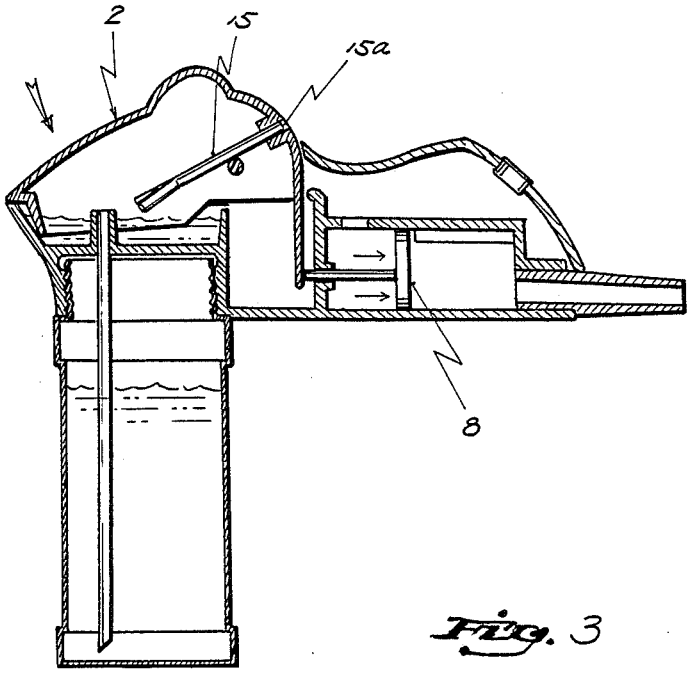
FIG. 3 is a cross-sectional view of the device of this invention in the closed position.

With attention to the drawings, the main body 1 of the invention may take the form of any type of toy or comic figure which has a mouth that opens and closes. The instant device is portrayed as a frog, but as will be obvious to those skilled in the art it could be any type of figure. However, the upper portion of the head 2 is movable and as will be subsequently explained, the air blowing action causes the mouth part of head 2 to open. The lower mouth or jaw 4 is intended to be a reservoir of bubble blowing liquid and mounts a reservoir 5 containing the liquid there below. A depending flange 3A is intended to be submerged within the liquid within reservoir 4A of lower jaw 4 when the mouth is closed as shown in FIG. 3.

Figure 1:
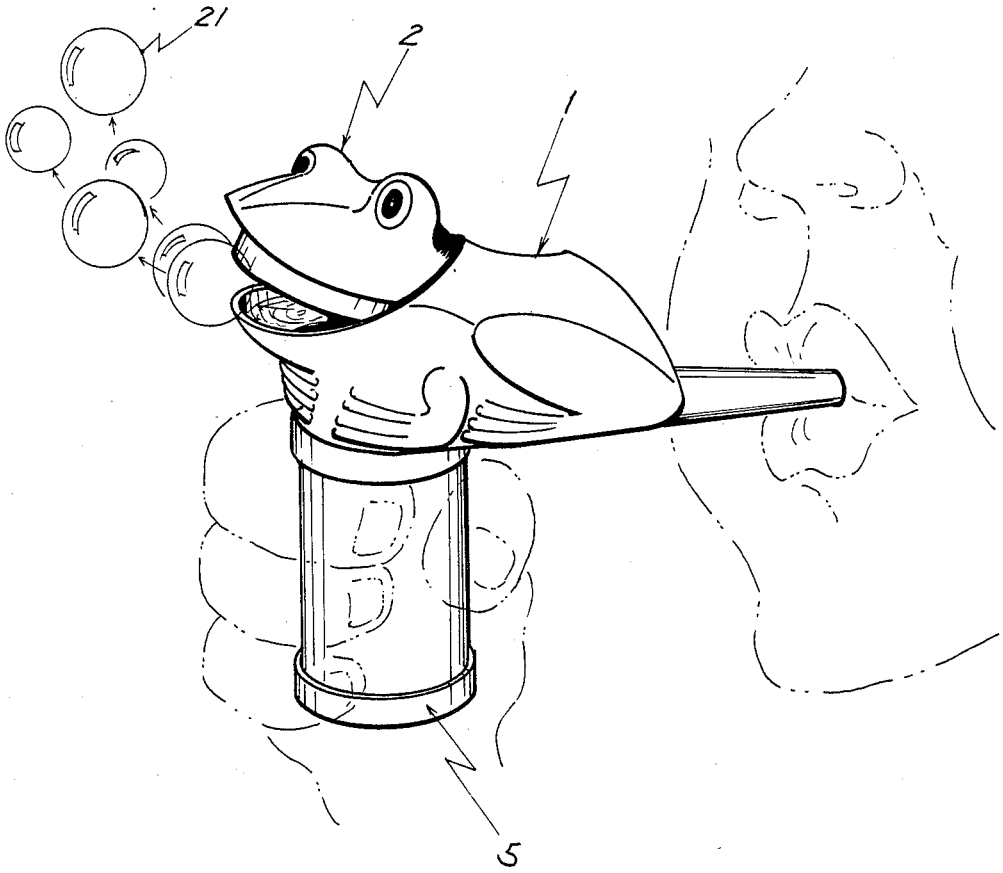
FIG. 1 is a perspective view of an embodiment of the device of this invention blowing bubbles with the bubble blower's face and hand in phantom.
Figure 2:
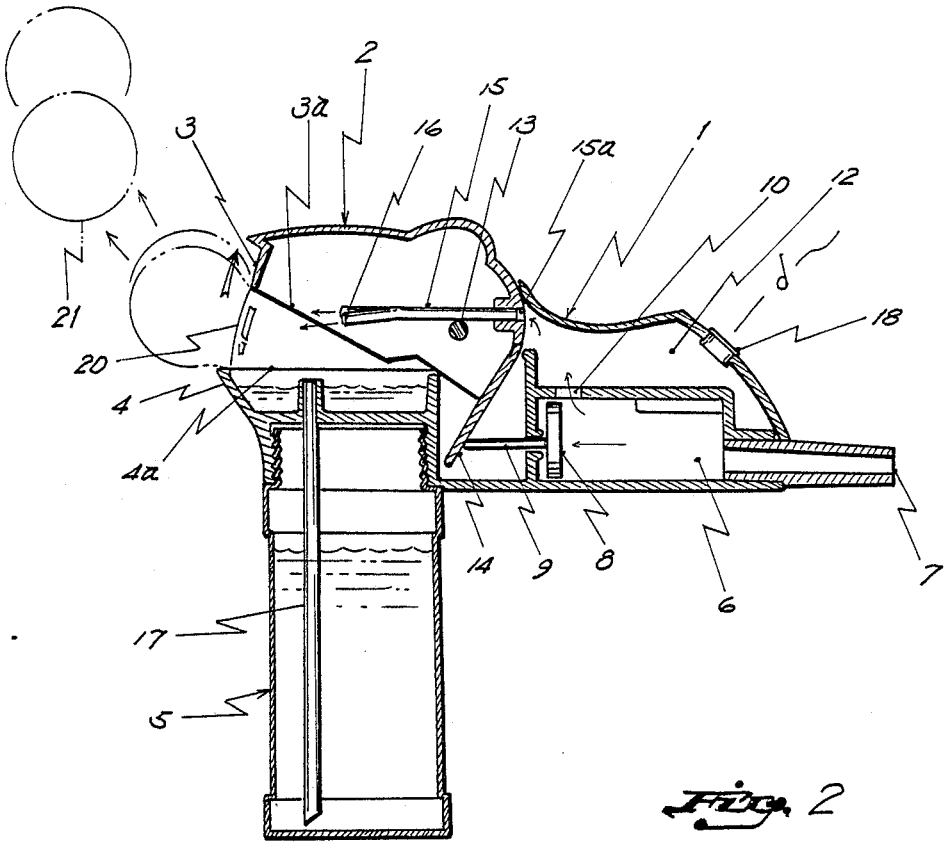
FIG. 2 is an cross-section view of the device of this invention in the open position blowing bubbles.

The opening action of the mouth parts 3 is described as follows:

At least one internal cylinder 6 is provided within the toy 1. A piston 8 having a rod 9 extending therefrom is mounted within the cylinder slidably, and the end of rod 9 normally engages a depending rigid member 14 extending from head 2. When air is admitted through blow pipe 7 into the cylinder 6 the piston slides rearwardly as shown in FIG. 2 causing the upper head member 2 to pivot opening the mouth. This movement also exposes opening 10 and air then escapes through opening 10 into chamber 12 and ultimately passes through opening 15A into nozzle 15 and out of nozzle 15 to blow bubbles. In addition, a sound siren or other type of sound emitting device 18 may be provided in chamber 12 to simulate a siren, bird's chirping, or the like. A pin 13 is provided through head 2 and body 1 to act as a hinge for opening and closing the mouth.

The device must be held upright to avoid spilling the bubble blowing liquid from reservoir 4. The depending flange 3 is shown herein as a solid member, but it could have teeth or the like molded therein. As noted, when the mouth closes the depending flange 3A dips into the liquid bubble blowing material in the lower jaw 4 and is immersed in the bubble blowing solution. When the mouth opens the liquid immediately forms a film 20 between edges 3A and 4A. Air from nozzle 16 then blows the bubbles. When the air ceases to be admitted to blow pipe 7, the weight of head 2 causes pivotal movement about pin 13 whereby the depending member 14 urges the piston laterally to the position shown in FIG. 3 and the mouth closes.

It should be noted that aperture 15A is not in communication with chamber 12 when the mouth is in the closed position. This permits a build-up of air pressure within chamber 6 so that when aperture 15A is placed in communication with chamber 12, the air will rush through the nozzle 16 to immediately blow bubbles before the film 20 can break or dissipate.

In addition, the pipe 15 of nozzle 16 can have branches or a plurality of said nozzles can be provided with one or more cylinders to blow bubbles in a row one corresponding to each nozzle.

As noted above, a reservoir tank 5 is mounted in the lower portion of lower jaw 4. A tube 17 extends from the lower portion of tank 5 upwardly through the lower portion of jaw 4 and into the reservoir contained therein. The tank 5 can be squeezable so that to refill the bubble blowing liquid in lower jaw 4, the user need only squeeze the tank 5 and liquid will be conveyed via tube 17.

In summary, the device of this invention uses a unique piston member for opening the mouth of the toy and for blowing bubbles therethrough. Air from a blow pipe then drives the piston within a cylinder rearwardly opening the mouth and at the same time opening a channel to a nozzle in the mouth whereby the air rushes from the nozzle. The upper jaw of the mouth has a depending flange which rests in the bubble blowing liquid when the mouth is closed. When the mouth opens a film is formed thereacross an the air then blow bubbles from the film.

I claim:

1. A bubble toy comprising:

a body having a head and mouth, said mouth comprising a lower jaw integral with said body, and an upper portion including an upper jaw, pivotally mounted to said head, said upper jaw having a depending flange disposed within said mouth so that when said upper jaw is closed against said lower jaw said depending flange will extend into said lower jaw, and said lower jaw defining a hollow reservoir;

said upper jaw and pivotally mounted head having a depending flapper member integral therewith and disposed distally to said depending flange, within said body;

a cylinder and a piston slidably mounted therein;

a blow pipe extending through said body into one end of said cylinder and an exit port in said cylinder disposed adjacent an end opposite said blow pipe;

a rod mounted on said piston and extending through the end of said cylinder opposite said blow pipe, the end of said rod engaging said depending flapper member;

a nozzle extending from a port in the rear of said movable head member toward said mouth;

said body defining an air channel placing the interior of said cylinder in communication with the nozzle port in said head only when said mouth is open whereby when air is admitted to the cylinder said piston will be driven backwardly and said rod will cause pivotal movement of said head by displacing said flapper member to open said mouth whereupon air from said cylinder will travel through said air channel and through said nozzle exiting the open mouth of the device thereby when bubble blowing liquid is in said reservoir, a film will be formed across said mouth which will produce bubbles when said mouth is open.

2. The device of claim 1 wherein said channel further comprises means for producing a predetermined noise in response to air pressure in said channel disposed in said body.

* * * * *